US005417782A

United States Patent [19]

Rongvaux

[11] Patent Number: 5,417,782

[45] Date of Patent: May 23, 1995

[54] HEAT TREATMENT PROCESS FOR A NI-BASED SUPERALLOY

[75] Inventor: Jean-Marc Rongvaux, La Norville, France

[73] Assignee: Societe Nationale d'Etude et de Construction de Moteurs d'Aviation "SNECMA", Paris, France

[21] Appl. No.: 70,862

[22] Filed: Jun. 3, 1993

[30] Foreign Application Priority Data

Jun. 3, 1992 [FR] France ..... 92 06696

[51] Int. Cl.[6] ..... C21D 1/26

[52] U.S. Cl. ..... 148/675; 148/555

[58] Field of Search ..... 148/675, 555

[56] References Cited

U.S. PATENT DOCUMENTS

| | | | |
|---|---|---|---|
| 2,570,194 | 10/1951 | Bieber et al. | 148/675 |
| 2,977,223 | 3/1961 | Brown | 148/675 |
| 4,676,846 | 6/1987 | Harf . | |
| 4,750,944 | 6/1988 | Snyder et al. | 148/555 |

FOREIGN PATENT DOCUMENTS

| | | | |
|---|---|---|---|
| 0402168 | 12/1990 | European Pat. Off. . | |
| 2089069 | 12/1971 | France . | |
| 2099818 | 2/1972 | France . | |
| 58-113361 | 7/1983 | Japan | 148/675 |
| 777703 | 6/1957 | United Kingdom . | |

OTHER PUBLICATIONS

E. F. Bradley, "Superalloys a Technical Guide," 1988, ASM International, Metals Park, Ohio, US, pp. 47 & 48.

Welding Journal. Including: Welding Research Supplement, vol. 65, No. 11, Nov. 1986, Miami, US, pp. 299s–304s, R. G. Thompson, et al., "Effect of heat Treatment on Microfissuring in Alloy 718".

*Primary Examiner*—Melvyn J. Andrews
*Assistant Examiner*—Margery S. Phipps
*Attorney, Agent, or Firm*—Oblon, Spivak, McClelland, Maier & Neustadt

[57] ABSTRACT

A nickel-based superalloy known by the designation "718" and having a typical composition comprising, in percentages by weight, Cr 19, Fe 18, Nb 5, and the remainder Ni, is subjected, after the usual thermo-mechanical and heat treatment steps, to an additional annealing step wherein the temperature and duration are selected from the following range as desired:

800° C. for between 5 and 30 hours;

750° C. for between 25 and 70 hours; and

700° C. for between 100 and 300 hours.

This leads to a definite improvement in the behaviour of parts made from the superalloy, in terms of fatigue cracking, when used at temperatures over 650° C.

3 Claims, 6 Drawing Sheets

HEAT TREATMENT PROCESS FOR A NI-BASED SUPERALLOY

BACKGROUND OF THE INVENTION

1. Field of the Invention

The present invention relates to the heat treatment of a nickel-based superalloy known under the trade name of "718" and having a typical composition comprising, in percentages by weight, Cr=19, Fe=18, Nb=5, and mainly Ni as the remainder.

This alloy is used in particular in the manufacture of highly stressed parts intended for aircraft engines, and the forming of these parts involves forging operations.

2. Summary of the Prior Art

The heat treatments applied to the parts before use normally comprise a solution and hardening treatment, and an annealing treatment. The conditions under which the solution treatment and the subsequent quenching are carried out are known and are not the subject of the present invention. For the sake of example, however, these may involve holding the part at a temperature between 955° C. and 1000° C. for a period of from one to two hours, and quenching with air, oil or water depending on the particular application. The conditions currently observed for carrying out the annealing treatment comprise, depending on the application, either holding the part at 720° C. for eight hours followed by cooling at an hourly rate of 50° C. until a temperature of 620° C. is reached, then holding the part at 620° C. for eight hours before returning it to ambient temperature in conditions equivalent to air cooling, or holding the part at 760° C. for five hours followed by cooling at an hourly rate of 50° C. until a temperature of 650° C. is reached, then holding it at 650° C. for one hour before cooling it with air.

Modifications to this standard treatment have been proposed with a view to obtaining certain particular results. For example, EP-A-O 402 168 proposes a staged heat treatment comprising a tempering treatment followed by a double annealing treatment in conditions close to currently used conditions, without intermediate quenching, so as to avoid the presence of delta phase elements at the grain boundaries. The result obtained is an improvement in the resistance of the alloy to stress corrosion.

Other known processes use thermo-mechanical treatments, some examples of which are disclosed in FR-A-2 089 069 and FR-A-2 099 818. However, the process of FR-A-2 089 069 retains the standard conditions for the annealing treatment of alloy 718, and the process of FR-A-2 099 818 proposes an annealing treatment comprising a six-hour stage at between 700° and 730° C. and a total time of eighteen hours at between 600° C. and 730° C.

The standard conditions for the annealing treatment of alloy 718 described above lead to the restriction of the use of this alloy for parts which are used at temperatures not exceeding 650° C.

SUMMARY OF THE INVENTION

One of the objects of the invention is to enable parts made of alloy 718 to be used at temperatures up to 700° C. and even 750° C.

Another object of the invention is to define particular conditions for an annealing treatment to be applied to parts made of alloy 718 before use which enables a satisfactory compromise to be achieved between the results of mechanical characteristics imposed on the parts during use. A particularly sought improvement relates to the resistance of the parts to fatigue cracking at working temperatures between 650° C. and 750° C.

Accordingly, the invention provides a heat treatment process for a nickel-based superalloy known by the trade name "718" and having a typical composition comprising, by weight, about 19% chromium, about 18% iron, about 5% niobium, and mainly nickel as the remainder, said process comprising pre-use heat treatment steps which are known for said superalloy, followed by an annealing step wherein the temperature and duration are selected from the following range:

800° C. for a time between five and thirty hours;

750° C. for a time between twenty-five and seventy hours;

700° C. for a time between one hundred and three hundred hours.

The particular annealing treatment conditions defined by the invention are especially applicable to an alloy 718 which has undergone a range of thermo-mechanical treatments in standard conditions, and which exhibits a resulting microstructure with a grain size of between 5 and 8 ASTM. However, the invention is also applicable to parts made of alloy 718 with different microstructures as a result of the particular conditions of the known treatments used before the annealing treatment defined by the invention.

Preferably, the supplementary annealing step following the known pre-use heat treatment steps is carried out at 750° C. for fifty hours.

One embodiment of the invention will now be described, by way of example, with reference to the attached drawings and a series of test results.

DESCRIPTION OF THE PREFERRED EMBODIMENT

Test-pieces were taken as forgings of an alloy 718 with a grain size of 5 to 8 ASTM and a composition which was verified by chemical analysis as comprising, in percentages by weight:

Cr: 18.23; Fe: 18.29; Nb+Ta: 5.26; Mo: 3.03; Al: 0.51; Ti: 0.93; Co: 0.15; Si: 0.04; Mn: 0.01; Cu: 0.02; C: 0.032; S: 0.003; P: 0.006, and the balance to 100 being Ni.

This composition is in conformity with the normal composition ranges for the alloy 718 designated NC 19 Fe Nb.

Figure 1:
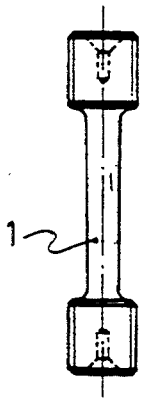
FIG. 1 shows a test-piece used for testing mechanical characteristics under tensile stress and creep.
Figure 2:
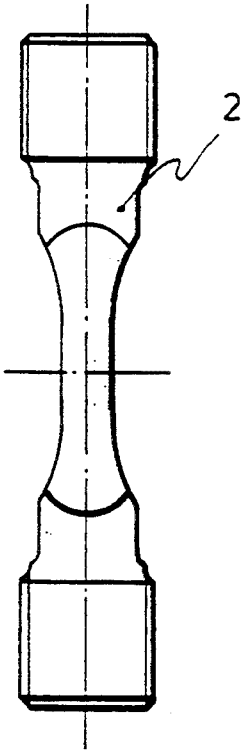
FIG. 2 shows a test-piece of a first type used for crack tests.
Figure 3:
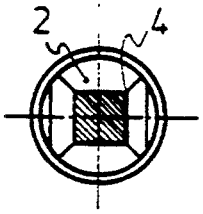
FIG. 3 is a cross-sectional view of the test-piece shown in FIG. 2.
Figure 4:
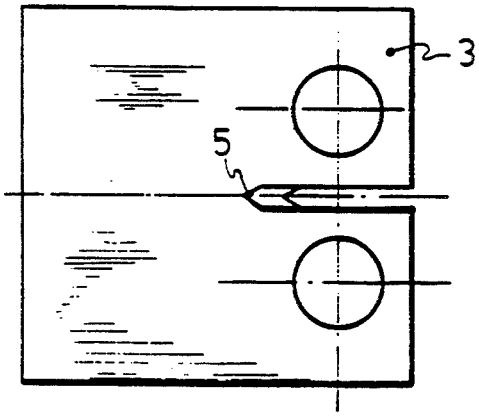
FIG. 4 shows a test-piece of a second type used for crack tests.
Figure 5:
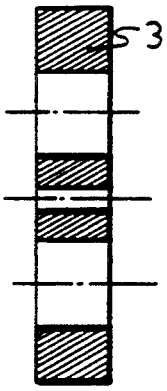
FIG. 5 is a cross-sectional view of the test-piece shown in FIG. 4.

The test pieces prepared for tensile and creep tests are as shown at 1 in FIG. 1 and are cylindrical with their working portion having a diameter of 4.5 mm and a length of 23 mm. The test-pieces prepared for crack propagation tests are of two types: namely the test-piece 2 shown in FIGS. 2 and 3 for short cracks, and the test-piece 3 shown in FIGS. 4 and 5 for long cracks. The test-piece 2 is in the form of a bar and has a crack 4 started on an edge of the bar and developing in a quarter circular shape. The test-piece 3 is 10 mm thick and has a bidimensional crack 5.

Tests were then carried out on test-pieces which had been subjected to one or other of two different heat treatment processes, namely:

a first process corresponding to a standard heat treatment and comprising putting the piece into solution at 955° C. for one hour and then cooling it in air, followed by an annealing step comprising holding the piece at 720° C. for eight hours, then cooling it at a rate of 50° C. per hour down to 620° C., holding this temperature for eight hours and then cooling the piece in air, and;

a second process in accordance with the invention and comprising the standard heat treatment described above followed by an additional high temperature annealing step carried out at 750° C. for fifty hours.

TEST RESULTS

Crack tests were carried out at 650° C., 700° C. and 750° C., by applying a trapezoidal cycle comprising a holding time of 90 seconds at maximum stress, at a charge ratio R of 0.05.

Test-pieces 2A and 2C of type 2 as described above with reference to FIGS. 2 and 3, and a test piece 3B of type 3 described above with reference to FIGS. 4 and 5 were tested after subjection to the first standard heat treatment process, and test-pieces, 2B, 2D, 2E, 3A and 3C were tested after subjection to the second heat treatment process in accordance with the invention.

The results obtained are summarized in the table below; in which $a_o$ is the dimension of the initial crack in mm, and $a_f$ is the dimension of the final crack in mm.

| Test temperature | Test-piece | $\sigma$ or P | $a_o$ mm | $a_f$ mm | Np cycles | Heat treatment process |
|---|---|---|---|---|---|---|
| 650 | 2A | 585 MPa | 0.7 | 3.60 | 167 | standard |
| | 2B | 585 MPa | 0.7 | 3.65 | 582 | invention |
| | 3A | 740 daN | 15.5 | 27,8 | 2670 | invention |
| 700 | 2C | 500 MPA | 1.6 | 4.4 | 17 | standard |
| | 2D | 500 MPa | 1.75 | 4.3 | 544 | invention |
| | 2E | 490 Mpa | 0.5 | 4.7 | 7807 | invention |
| 750 | 3B | 745 daN | 15.1 | 28.9 | 17 | standard |
| | 3C | 630 daN | 15.0 | 27.5 | 7617 | invention |

Figure 6:
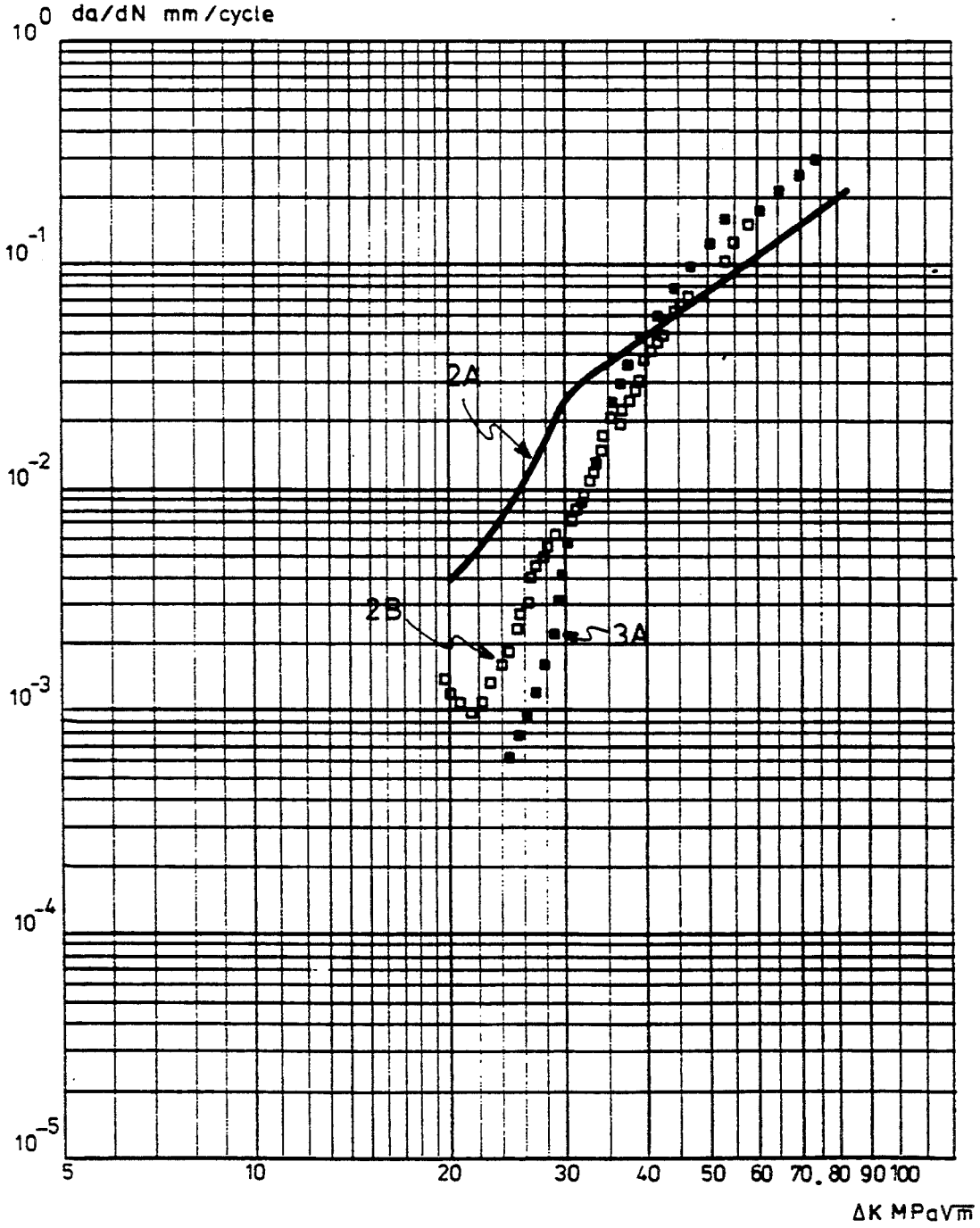
FIG. 6 is a diagram showing crack curves obtained by testing test-pieces at 650° C.
Figure 7:
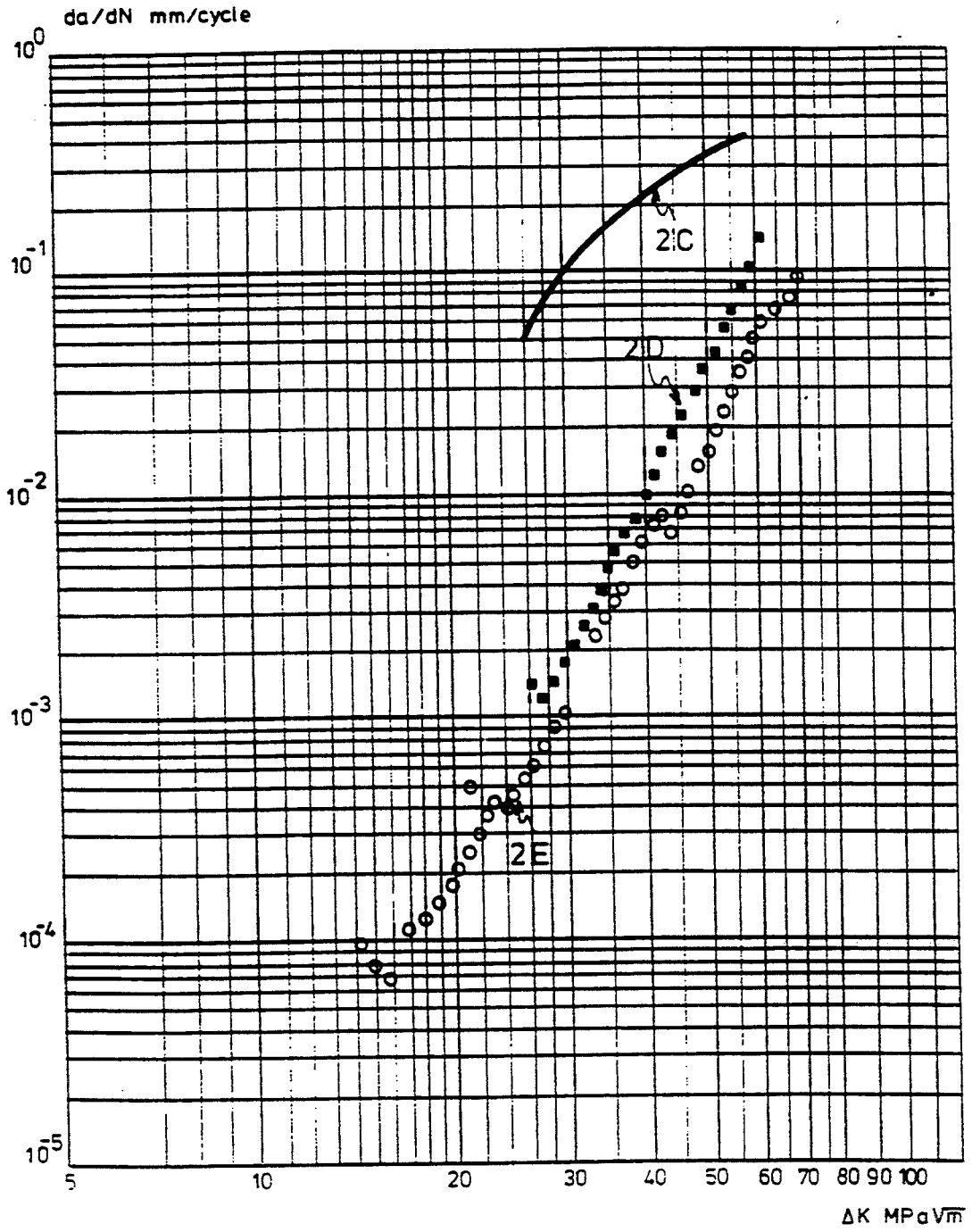
FIG. 7 is a diagram showing crack curves obtained by testing test-pieces at 700° C.
Figure 8:
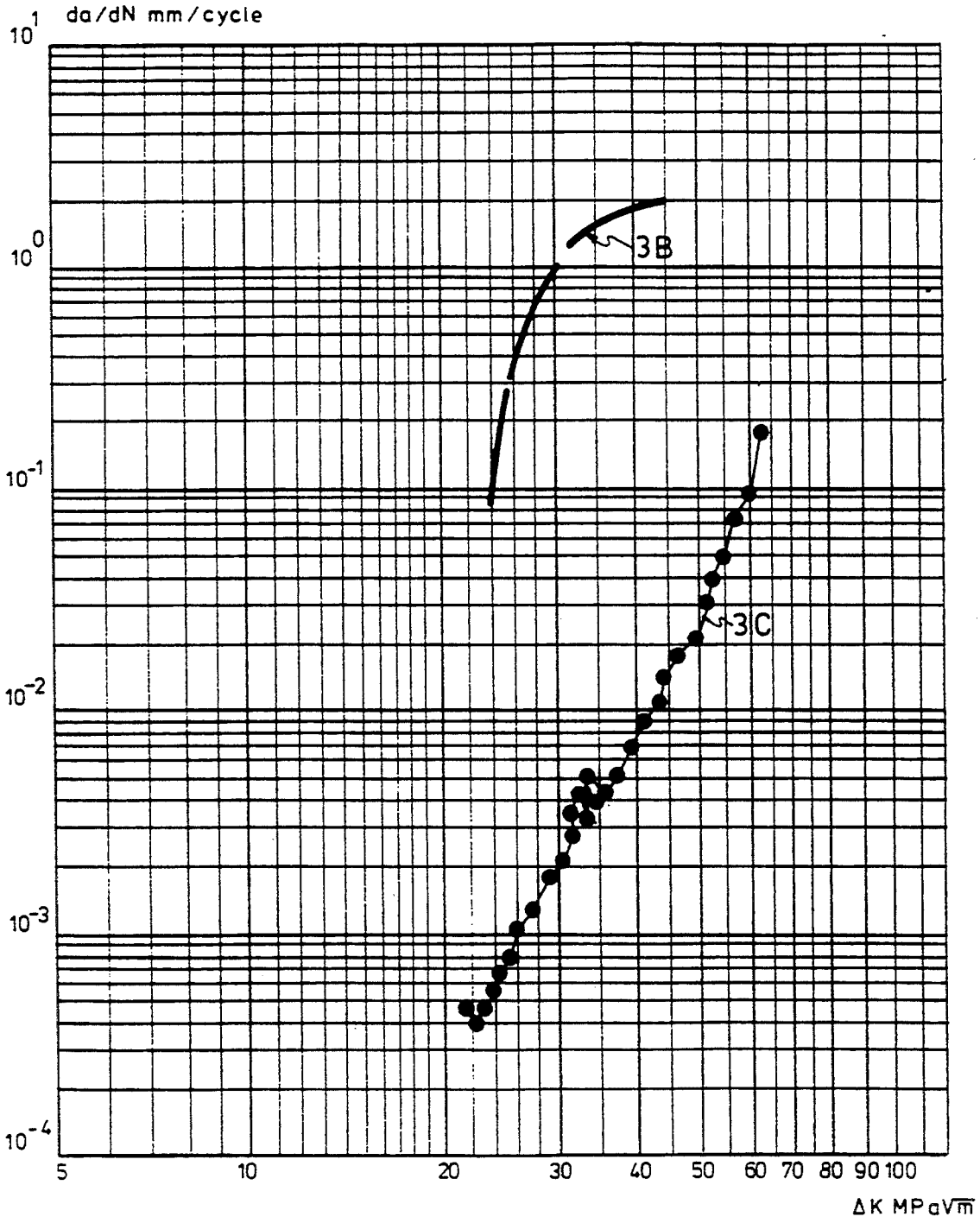
FIG. 8 is a diagram showing crack curves obtained by testing test-pieces at 750° C.

FIGS. 6, 7 and 8 show the corresponding crack curves for the tests at 650° C., 700° C. and 750° C. respectively. Each curve is marked by the corresponding reference of the test-piece noted above.

These bilogarithmic diagrams give the cracking rate as ordinates in da/dN or mm per cycle as a function of the amplitude of the stress intensity factor as abscissae, $\Delta K$ in MPa $\sqrt{m}$.

Figure 9:
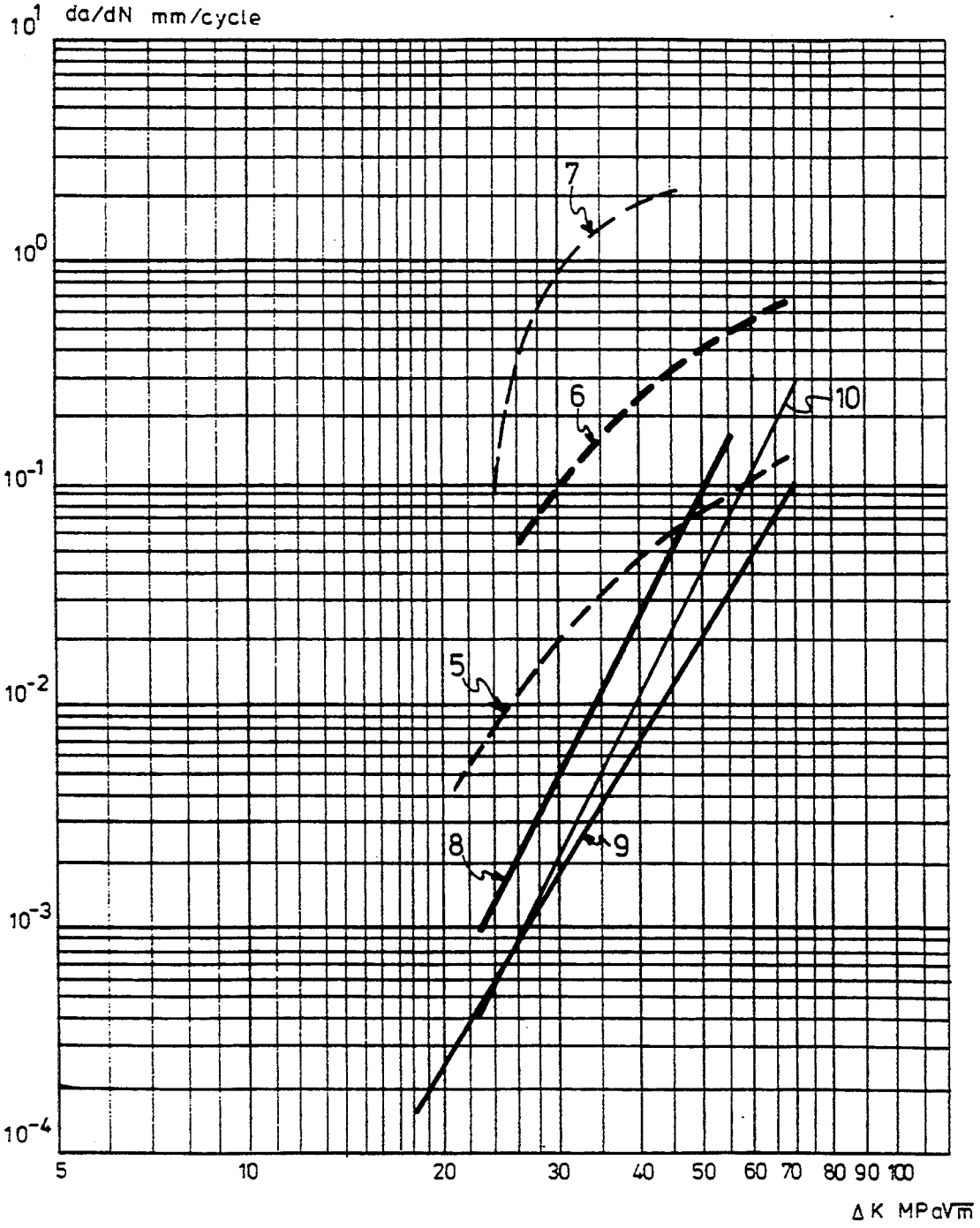
FIG. 9 is a diagram summarizing the crack curve test results.

FIG. 9 shows a summary diagram of the results of the crack tests. Curves 5, 6 and 7 show the results for the standard heat treatment process, and curves 8, 9 and 10 for the heat treatment process in accordance with the invention, at the respective test temperatures of 650° C., 700° C. and 750° C.

A complete analysis of the results of the cracking tests, some significant examples of which have been noted above, leads to the following conclusions. The results obtained at 650° C. correspond to operation in the usual temperature range for alloy 718, whereas one of the aims of the invention is to ensure a satisfactory resistance of parts made from the alloy at operational temperatures above 650C. A comparison of the cracking curves shown in FIGS. 6 and 9, however, indicates that the heat treatment in accordance with the invention gives alloy 718 a better resistance up to $\Delta K=40$ Mpa $\sqrt{m}$ and the crack propagation rate between 20 and 30 MPa $\sqrt{m}$ is reduced by a factor of between 4 and 5. Comparing the results of the test-pieces 2A and 2B there will be observed, in addition, an overall difference by a factor of 3.5 in favour of the heat treatment process of the invention, in terms of length of life in crack propagation.

The results obtained at 700° C. show a very substantial increase in the cracking resistance of alloy 718 with the heat treatment process of the invention. Indeed, a gain by a of factor 50 in the crack propagation rate is observed at $\Delta K=30$ MPa $\sqrt{m}$, and a substantial difference remains when $\Delta K$ increases. There is noted furthermore a difference by a of factor 30 in the number of crack propagation cycles between the test-pieces 2C having the standard heat treatment and the test-pieces 2D having the heat treatment of the invention.

The results obtained at 750° C. show that alloy 718 heat treated in accordance with the invention is very decidedly superior to the alloy treated under standard conditions, in terms of resistance to fatigue cracking with time when held under load. The crack propagation rate is some 500 times lower when $\Delta K=30$ MPa $\sqrt{m}$.

An examination of the summary diagram of FIG. 9 also enables one to note that with the standard heat treatment, temperature has a substantial effect on cracking rate whereas, in contrast, with the heat treatment according to the invention, the effect of temperature is much lower. The result is that the difference in crack resistance increases in favour of alloy 718 treated in accordance with the invention. To sum up, the favourable difference factor varies at $\Delta K=30$ MPa $\sqrt{m}$, from 4 at 650° C., to 50 a 700° C. and as far as 500 at 750° C.

It will thus be appreciated that the heat treatment applied to alloy 718 in accordance with the invention enables one of the aims of the invention to be achieved, i.e. an improvement in the resistance of parts made from the alloy to cracking when the working temperature ranges from 650° C. to 750° C.

However, it was felt appropriate to check also that this improvement is not secured to the detriment of other mechanical characteristics of the parts, and that these remain within acceptable value limits. The results of tensile tests carried out on test-pieces 1 are given in the table below in which:

R is the breaking load resistance;

R 0.2 is the elasticity limit at 0.2 per cent;

A is elongation; and,

Z is reduction in area.

Comparisons at the different test temperatures are given in mean differences and in percentages relative to a reference having the standard heat treatment for a test-piece treated in accordance with the invention.

| | 550° C. | 650° C. | 700° C. | 750° C. |
|---|---|---|---|---|
| R | −2 | −11 | −11 | −11 |
| R 0.2 | −22 | −12 | −10 | −4 |
| A | +11 | +60 | +52 | +61 |
| Z | +12 | +80 | +60 | +49 |

At the usual temperatures of use for alloy 718 the treatment in accordance with the invention is found to be disadvantageous, particularly with respect to the elasticity limit. The differences are attenuated when the temperature of use rises. A reverse effect is observed with respect to the properties of elongation and reduction in area. Overall, the results obtained remain acceptable for use.

Tests were also carried out for creep at various temperatures of use, i.e. 600° C., 700° C. and 750° C. The results are shown in the table below and, as before, are expressed as differences in percentages on comparing the test-piece treated in accordance with the invention with test-pieces having the standard treatment.

$\sigma_R$ is the creep under breaking stress at 200 hours, $\sigma_{0.2}$ is the creep under elongation stress of 0.2% at 50 hours.

| | 650° C. | 700° C. | 750° C. |
|---|---|---|---|
| σ R | −2 | 0 | 0 |
| σ 0.2 | −22 | −4 | 0 |

Except for creep at 0.2% elongation at 650° C. few variations in behaviour are observed, and the results are also acceptable for use.

Micro-structural examinations carried out on the test-pieces 2 for the cracking tests enable a correlation to be made between the different microstructres obtained as a result of the heat treatments applied and the results of the corresponding mechanical characterization tests.

Figure 10:
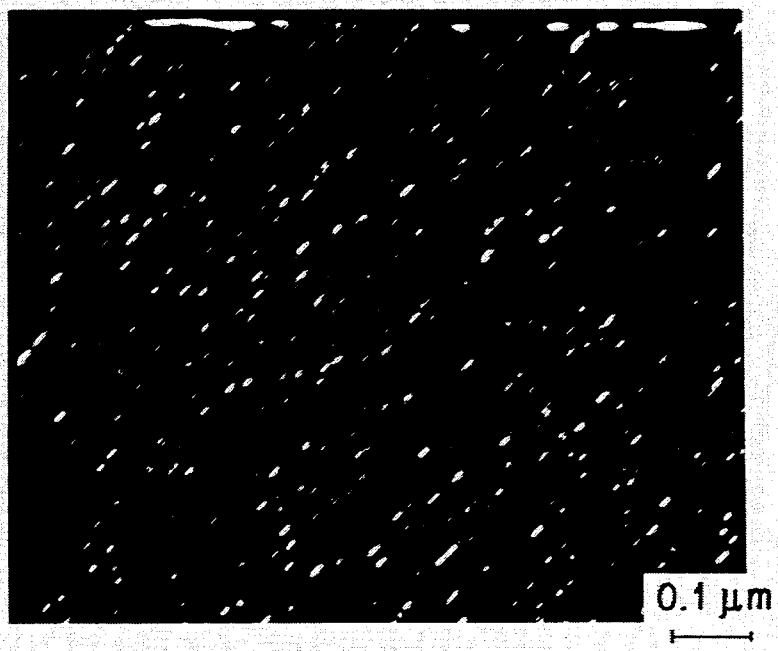
FIG. 10 is a reproduction of a microphotograph showing the microstructure of an alloy 718 test-piece treated under standard conditions.
Figure 11:
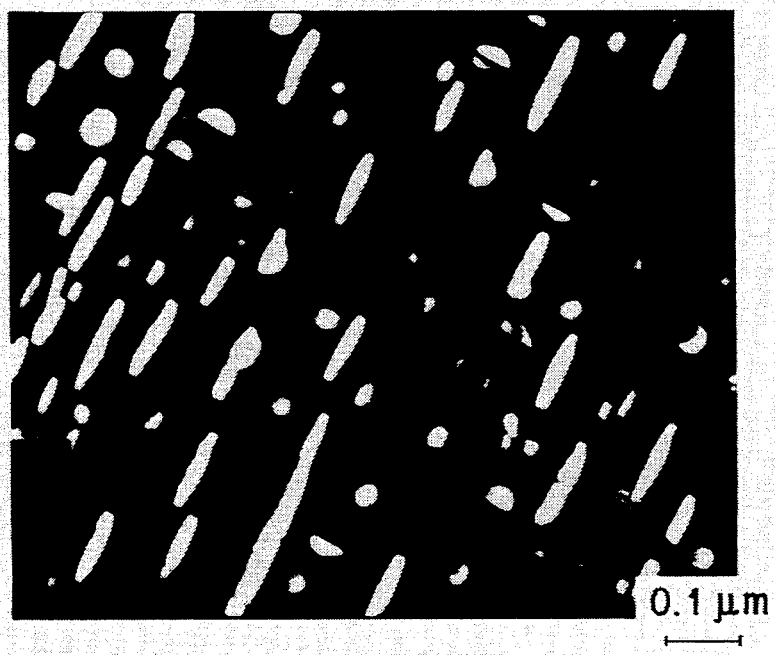
FIG. 11 shows, in a manner similar to that of FIG. 10, the microstructure of an alloy 718 test-piece treated under conditions in accordance with the invention.

The microphotograph obtained by transmission electron microscopy on the test-piece 2C heat treated in the standard manner is shown in FIG. 10, and shows the size of precipitates of the gamma double-dash and gamma dash phases to be above 100 Å. The microphotograph obtained in the same manner by transmission electron microscopy on the test-piece 2D heat treated in accordance with the invention is shown in FIG. 11 and shows an average size for the of gamma-dash phase precipitates of about 500 Å and a size for the gamma double-dash precipitates ranging from 1000 Å to 2000 Å.

This microstructure is characteristic of a strong coalescence of the precipitates of the gamma double-dash and gamma dash hardening phases of the alloy resulting from the heat treatment applied in accordance with the invention. A microstructure with large-size precipitates Of gamma double dash and gamma dash phases of the alloy 718 consequently induces an improvement in the cracking resistance of the alloy, hence the interest and the advantages stemming from the heat treatment of the invention which enables this microstructure of the alloy to be obtained.

Additional tests have shown that the microstructure from which the improvement in the high temperature cracking resistance of the alloy stems may be obtained by varying, within specific limits, the temperature and duration of the additional annealing step in accordance with the following range:

800° C. for from five to thirty hours;

750° C. for from twenty-five to seventy hours; or

700° C. for from one hundred to three hundred hours.

The choice from these particular conditions in accordance with the invention is made for each particular application depending on the means available and the manufacturing facilities, and also depending on the particular parts to be treated. Moreover, the same improvements are obtained by applying the said additional annealing step defined by the invention to parts made from a superalloy of 718 type which have previously been subjected to thermo-mechanical treatment and heat treatment in conditions different from the standard conditions leading, in particular, to microstructures with a grain size different from the 5 to 8 ASTM standard.

What is claimed is:

1. A process for heat treating 718 nickel-based superalloy comprising:

(a) a pretreatment, comprising:

maintaining said superalloy at a temperature between 955° C. and 1000° C. for from 1 to 2 hours, followed by quenching said superalloy with air, oil or water;

maintaining said superalloy at 720° C. for 8 hours, then cooling said superalloy at a rate of 50° C. per hour to 620° C., holding at 620° C. for 8 hours, and then cooling said superalloy with air; and (b) a post-treatment comprising:

maintaining said superalloy between a temperature of 800° C. to 700° C. for from 5 to 300 hours, wherein gamma double-dash precipitates ranging in size from 1000Å to 2000Å are formed.

2. The process according to claim 1, wherein during said post-treatment, said superalloy is maintained at 750° C. for 50 hours.

3. A heat treatment process for 718 nickel-based superalloy comprising:

(a) a pretreatment, comprising, heat treating said superalloy such that said superalloy has a microstructure with a grain size between about 5 and about 8 ASTM;

(b) a post-treatment comprising:

maintaining said superalloy at 750° C. for 50 hours, wherein gamma double-dash precipitates ranging in size from 1000 Å to 2000 Å are formed.

* * * * *

UNITED STATES PATENT AND TRADEMARK OFFICE

CERTIFICATE OF CORRECTION

PATENT NO. : 5,417,782

DATED : May 23, 1995

INVENTOR(S) : Jean-Marc RONGVAUX

It is certified that error appears in the above-identified patent and that said Letters Patent is hereby corrected as shown below:

COLUMN 3, line 48, please insert a space after "$a_0$";

line 49, please insert a space after "$a_f$";

line 57 of the table, "27,8" should read --27.8--.

COLUMN 4, line 16, "650C" should read --650$^{o}$C--;

line 52, "to 50 a 700$^{o}$C" should read --to 50 at 700$^{o}$C--.

COLUMN 5, line 41, "microstructres" should read --microstructures--.

Signed and Sealed this

Twenty-seventh Day of August, 1996

Bruce Lehman

*Attest:*

BRUCE LEHMAN

*Attesting Officer*

*Commissioner of Patents and Trademarks*